United States Patent [19]

Seitz

[11] 4,130,230

[45] Dec. 19, 1978

[54] SHEET FEED TRACTOR

[75] Inventor: Alan F. Seitz, Harwinton, Conn.

[73] Assignee: Data Motion Incorporated, Torrington, Conn.

[21] Appl. No.: 847,234

[22] Filed: Oct. 31, 1977

[51] Int. Cl.[2] ..... B65H 17/34

[52] U.S. Cl. ..... 226/75; 74/231 C

[58] Field of Search ..... 226/74, 75; 74/231 C, 74/243 C, 231 R; 198/834

[56] References Cited

U.S. PATENT DOCUMENTS

| | | | |
|---|---|---|---|
| 2,633,354 | 3/1953 | Mixer | 226/75 |
| 3,404,576 | 10/1968 | Cicognani | 74/231 C X |
| 3,930,601 | 1/1976 | Masuda | 226/74 |

*Primary Examiner*—Richard A. Schacher

[57] ABSTRACT

A drive tractor of the type usually mounted in pairs at opposite edges of a web of edge-perforated sheet material such as printout paper has an endless drive belt mounted on a chassis. The drive belt has pin members projecting from it to engage edge perforations in the web and is engaged with a drive wheel having sprocket teeth which engage a drive formation on the inner surface of the belt. The sprocket wheel is engaged by a drive shaft to be driven thereby. The sprocket teeth and belt tread are respectively configured to mesh only in a predetermined relative position of the pin members relative to the rotational position of the drive wheel. The drive wheel is configured to seat on the drive shaft in a predetermined rotational orientation. Therefore, when a pair of such tractors is mounted on a common drive shaft their respective drive wheels are in the same rotational orientation which automatically transversely aligns the respective pin members of the paired tractors.

17 Claims, 17 Drawing Figures

10
12
14
16
18
20
26
30
34
42
44
52
54
56
56A
56B
58
60
62
62A
64
64A
66
68
70
72
72A
72B
74
76
78
80
82
84
86
88
90
92
94
96
98
100
102
104
104A
106
108
108A
108B
108C
110
110A
110B
110C
112
114
116
118
120
122
124
128
134
138
140
142
144
146
154
156
158
160
162
164
168
170
172
184
186
62B
64B

SHEET FEED TRACTOR

BACKGROUND OF THE INVENTION

The present invention concerns, generally, tractors for feeding or advancing web material such as edge perforated webs of paper. As such, the devices of the present invention are especially suited to drive webs of paper such as those employed in computer printout equipment, teletypewriters, optical character readers and the like. However, the tractors capable of broader application, in general for feeding a web of paper or paper-like material in either continuous web or individual sheet form.

Devices adapted to this purpose are, of course, old and well-known in the art. Generally, such tractors include an endless belt trained in a loop over sprocket wheels which are driven by a drive shaft of the equipment (printer, etc.) on which the tractor is mounted. The belt typically has pins projecting from it to engage perforations provided in the paper or other material to drive the material along a linear path. The belt is trained over supports to curve away from the linear path and then return along the loop back to the linear path. Such tractors are normally employed in pairs at opposite edges of the web of material to drive it from both its opposite edges.

One problem associated with such prior art devices is that of maintaining proper transverse alignment of the pins of the spaced-apart paired tractors. The web material has a line of perforations adjacent its two opposite edges and the perforations are transversely aligned relative to the direction of travel of the web material. That is, each perforation adjacent one edge has a corresponding perforation adjacent the opposite edge, both perforations lying on a common line perpendicular to the direction of web travel. Since the pins of the two tractors thus must be aligned transversely across the space through which the web travels, care must be taken when assembling the tractors to effectuate such alignment, which is normally done manually, because the tractors are normally mounted on a common drive shaft. Thus, if the pins of the paired tractors are not transversely aligned once they are assembled, the alignment cannot be corrected simply by rotating one tractor drive while holding the other since both will rotate simultaneously and it becomes necessary to remove one of the belts or otherwise disassemble the device to correct the cross alignment.

It is accordingly an object of the present invention to overcome the foregoing and other shortcomings of the prior art by providing a novel tractor construction and a novel assembly for driving web material including a pair of such drive tractors.

It is another object of the present invention to provide a novel drive tractor construction in which the pins of paired tractors are automatically aligned transversely across the web material travel space between them upon assembly of the tractors to a common drive shaft or to synchronized drive shafts. Other objects and advantages of the present invention will become apparent from the following description thereof.

SUMMARY OF THE INVENTION

In accordance with the present invention there is provided a drive tractor for driving web material comprising a chassis having means thereon for mounting said chassis in proximity to a drive member, and belt driving means mounted on the chassis. The belt driving means includes a drive wheel mounted for rotation on the chassis and adapted to be operatively connected to the associated drive member to be rotated thereby. The drive wheel has a locating element on the periphery thereof.

A flexible endless belt has an outer driving surface and an inner driven surface. The belt driven surface engages the drive wheel for driving of the belt in a path of travel and includes a locating formation thereon dimensioned and configured to mesh with the wheel locating element but not with other segments of the drive wheel periphery. The belt outer surface has a plurality of spaced apart pin members disposed along the length thereof and projecting outwardly therefrom. The pin members are adapted to engage a web material for driving thereof along a portion of the path of travel. The belt locating formation has a predetermined spatial relationship relative to the belt pin members whereby engagement of the belt locating formation with the wheel locating element places the pin members at respective predetermined locations along the path of travel relative to the rotational position of the drive wheel.

Certain objects of the invention are attained when the drive wheel has a plurality of sprocket teeth formed along its periphery, including at least one sprocket tooth differently configured from others of the sprocket teeth, and the locating element comprises the differently configured sprocket tooth. The belt inner surface may have a drive formation formed thereon comprising a plurality of belt teeth dimensioned and configured to drivingly mesh with the sprocket teeth and the drive formation may include at least one locating segment thereof dimensioned and configured to mesh with the differently configured sprocket tooth but not with the others of the sprocket teeth.

In one aspect of the invention, the drive wheel has a plurality of first sprocket teeth comprising the differently configured sprocket teeth and a plurality of second sprocket teeth of different (preferably wider) radial width than the first plurality of sprocket teeth and located between the first sprocket teeth, and the drive formation has a plurality of spaced apart locating segments, each dimensioned and configured to snugly mesh with respective ones of the first sprocket teeth but not with ones of the second sprocket teeth.

Certain objects of the invention are attained when the drive wheel includes orientation means thereon configured to fix the drive wheel in a given rotational orientation relative to the associated drive member.

The present invention also provides an assembly for driving web material, including a pair of drive tractors as described above in the paragraph immediately following the heading Summary of the Invention. In such an assembly, the drive member may be an elongated drive shaft, with said tractors spaced apart along the drive shaft and having their respective drive wheels engaged therewith and disposed in the identical rotational orientation relative to the drive shaft, whereby the respective pin members of the belts are transversely aligned relative to the direction of belt travel. The assembly may further include a support comprising an elongated support bar disposed in proximity to the drive member and adapted to have the tractors mounted thereon spaced apart from each other.

DESCRIPTION OF THE PREFERRED EMBODIMENTS

Figures 1, 1A:
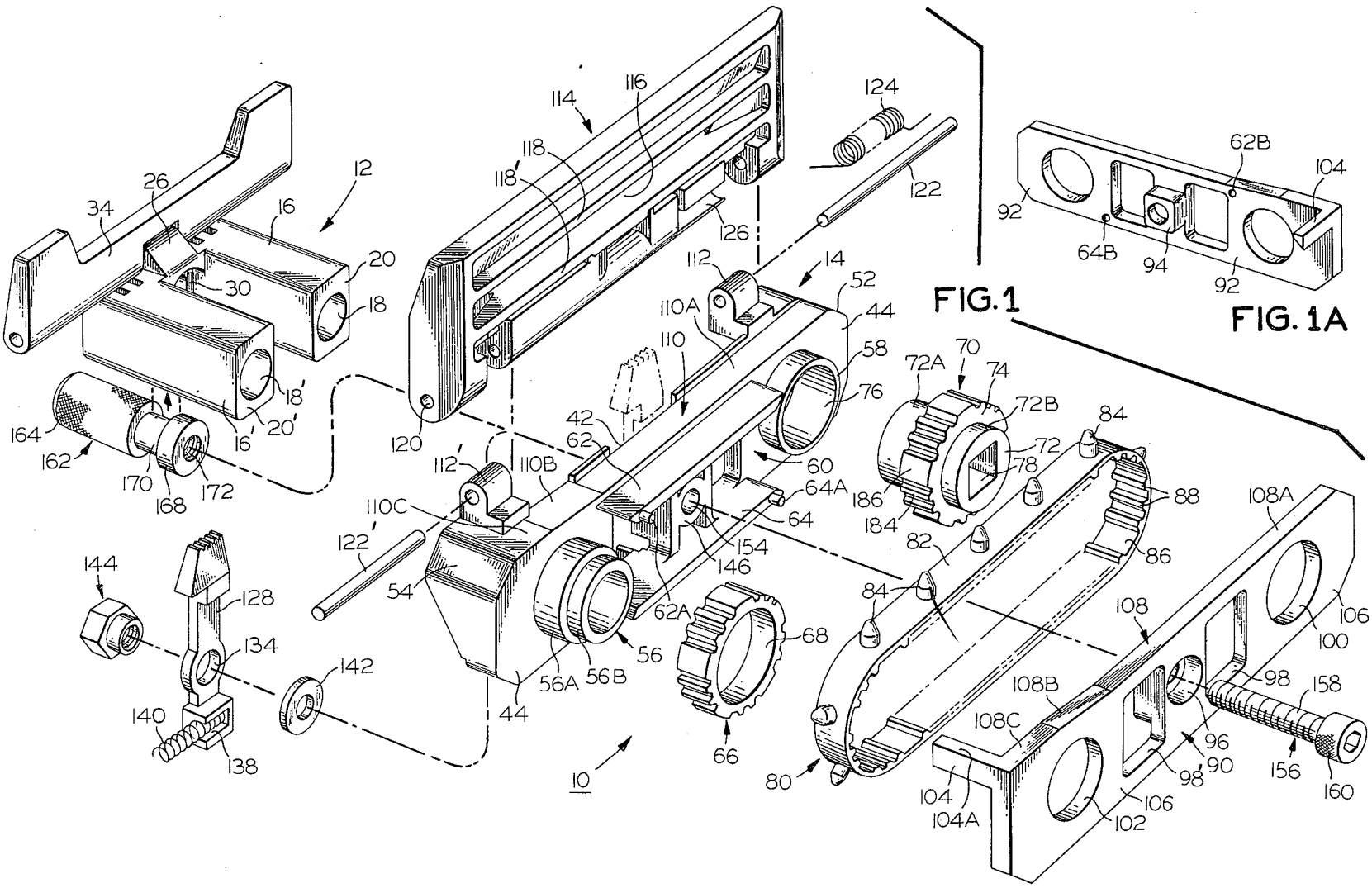
FIG. 1 is an exploded perspective view of one embodiment of a drive tractor in accordance with the present invention.
FIG. 1A is a perspective view of a component of the assembly of FIG. 1 showing its side opposite to that shown in FIG. 1.
Figure 4:
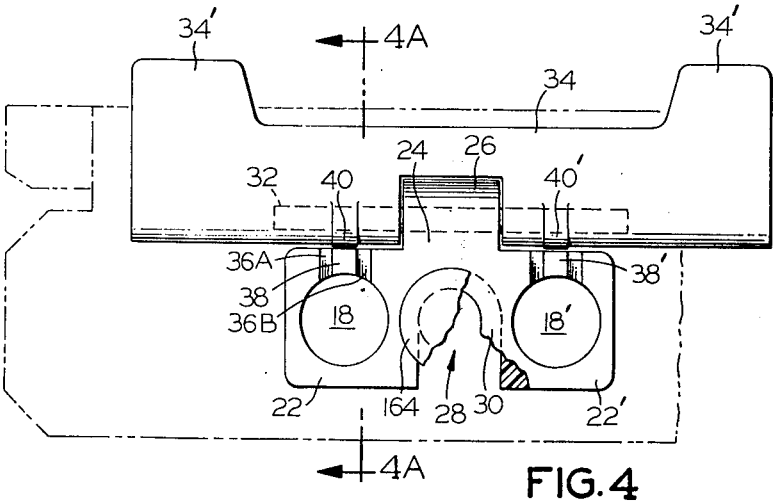
FIG. 4 shows the base member omitted from FIG. 3 in the same perspective as it would be viewed in FIG. 3, the base member being shown with its locking tab in the unlocked position, the portion of the device shown in FIG. 3 being partially indicated in dot-dash outline in FIG. 4.
Figure 4A:
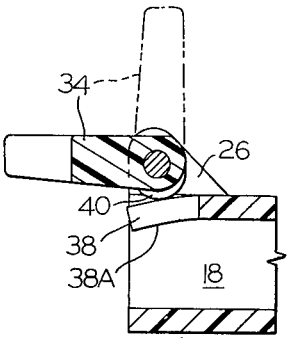
FIG. 4A is a section view in elevation along line 4A—4A of FIG. 4 showing the locking tab in solid line in its locked position and in dot-dash line in its unlocked position.

FIG. 1 shows, in exploded view, a drive tractor, generally indicated at 10 including a base member 12 and a chassis 14. Base member 12 has a generally U-shaped configuration. The various components are assembled as indicated by the dot-dash lines in FIG. 1. Base member 12 is comprised of guide means comprising a pair of parallel spaced apart shaft elements 16, 16' each of which is generally rectangular in cross section but having somewhat rounded corners. Each shaft element 16, 16' has a central bore 18, 18' formed therein and extending longitudinally of shaft elements 16, 16' and passing completely therethrough from front faces 20, 20', which comprise the forward end of base member 12, to rear faces 22, 22' (FIG. 4) which comprise the trailing end of base member 12. As best appreciated by referring jointly to FIGS. 1, 4 and 5, shaft elements 16, 16' are joined at the trailing end of base member 12 by a connecting web portion 24 which terminates at its upper end in a hinge block 26 of generally triangular shape, as best seen in FIG. 4A. As best seen by referring jointly to FIG. 4 and drive tractor 10 in FIG. 5, connecting web portion 24 has an arch shaped opening 28 formed therein which is undercut to provide an inverted U-shaped lip 30 therearound to seat a rotatable threaded member as described in more detail below.

Hinge block 26 has a bore (unnumbered) formed therein extending in a direction perpendicular to the longitudinal axes of shaft elements 16, 16' to receive therein a lock hinge pin 32. An elongated locking tab 34 is of generally planar construction having a central cutout portion (unnumbered) sized to fit over hinge block 26 and having bores (unnumbered) extending longitudinally adjacent the hinged portions thereof to receive opposite end segments of lock hinge pin 32, as best shown in FIGS. 4 and 4A. A shallow U-shaped cutout portion at the free edge of locking tab 34 provides a pair of ears 34'.

At the rear faces 22, 22' of base member 12 a pair of parallel slots 36A, 36B are cut into the topmost surface of shaft element 16 and extend into central bore 18. As best seen in FIG. 1, slots 36A, 36B (unnumbered in FIG. 1 for clarity of illustration) extend for a short distance along the longitudinal axis of shaft element 16 to provide a projecting tab 38 extending along an upper, trailing end portion of central bore 18. An identical projecting tab 38 is provided above central bore 18' by identically configured slots (unnumbered).

As shown in FIGS. 4 and 4A a pair of bosses 40, 40' are formed adjacent hinged edge 34A of locking tab 34. Bosses 40 are configured and sized so that with locking tab 34 in its vertical open position illustrated in dot-dash line in FIG. 4A, projecting tab 38 (and projecting tab 38') is not forced downwardly by boss 40 but is in its free position with its lower surface 38A forming part of the cylindrical inner surface of bore 18. However, with locking tab 34 rotated to the horizontal position shown in solid line in FIG. 4A, boss 40 biases locking tab 38 downwardly to provide a locking action on a rod journaled within bore 18 as described more fully hereinbelow. The identical action is provided by boss 40' on tab 38'.

Chassis 14 is of elongated construction and includes a chassis frame 42 which has a first sidewall portion 44 of planar configuration extending from feed end 46 to discharge end 48 (FIG. 2) of tractor 10.

Figure 3:
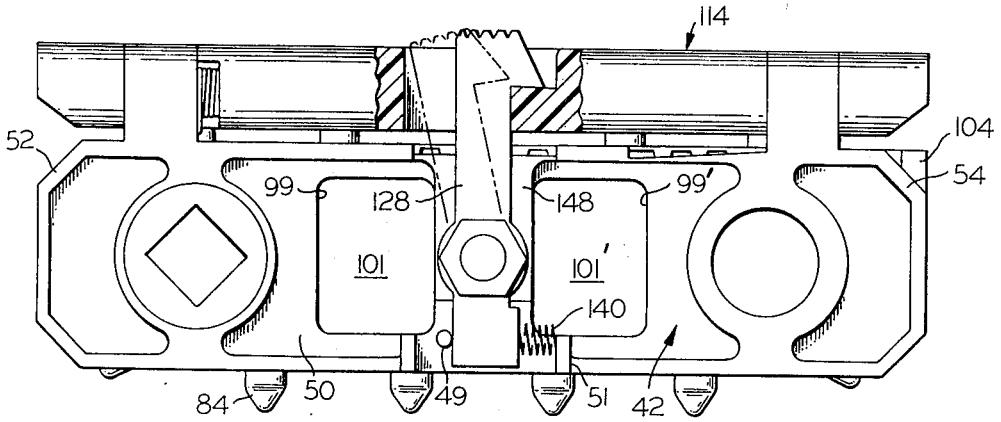
FIG. 3 is a side view in elevation of the tractor of FIG. 1, showing its side opposite to that shown in FIG. 2 and with its cover in the closed position and partially broken away, and its base member omitted for clarity of illustration.

Referring jointly to FIGS. 1 and 3, chassis frame 42 is seen to be of generally beam-line construction having a web portion generally indicated at 50 in FIG. 3 from which laterally projects a flange-like feed end shoulder 52 and a discharge end shoulder 54. Planar first sidewall portion 44 is provided by the side of web portion 50 oppposite that from which shoulders 52, 54 project. An idler wheel bearing 56 projects outwardly of first sidewall portion 44. Idler wheel bearing 56 is in the form of a hollow cylinder having a stepped outer surface so that the outer diameter of the cylinder is larger at the base 56A projecting from first sidewall portion 44 than it is at the top 56B, as best seen in FIG. 1. A drive sprocket bearing 58 in the form of a simple hollow cylinder is provided at the end of chassis frame 42 adjacent feed end shoulder 52. Extending longitudinally between idler wheel bearing 56 and drive sprocket wheel bearing 58 is a belt support means 60 comprising a belt drive support element 62 and a belt return guide element 64. Support elements 62 and 64 are spaced apart from each other sidewise of chassis frame 42 and have respective assembly pins 62A, 64A projecting laterally from their side edges.

A toothed idler wheel 66 has an inner bearing portion 68 adapted to fit over idler wheel bearing 56 to be rotatably mounted thereon.

A toothed drive sprocket wheel 70 has a central cylindrical portion on which is formed a ring 74 having the sprocket teeth formed therein. Cylindrical portion 72 projects beyond opposite sides of ring 74 and cylindrical outer surface 72A is sized to be rotatably received within inner bearing portion 76 of sprocket wheel bearing 76 of sprocket wheel bearing 58. A shaftway 78 of square cross section extends longitudinally through cylindrical portion 72 from one end thereof to the other. Thus, idler wheel 66 is adapted to be mounted for rotation on bearing 56 and sprocket wheel 70 is adapted to be mounted for rotation on bearing 58.

An endless belt 80 is made of a flexible material and is adapted to be trained over wheels 56 and 70 in a loop. Belt 80 has an outer driving surface 82 from which a plurality of web engaging means comprising pins 84 project. Pins 84 are spaced apart along the length of belt 80 and project perpendicularly outwardly of driving surface 82 thereof. Pins 84 are centered on the longitudinal center line of driving surface 82 and are spaced apart equally along the length thereof. Inner driven surface 86 of belt 80 has a plurality of belt teeth spaced apart along the length thereof and extending transversely across surface 86. Inner driven surface 86 is adapted to mesh with the teeth of wheels 66 and 70 to drive belt 80.

A chassis plate 90 is of elongated generally planar construction and, as shown in FIG. 1A, has an inner side thereof comprising a planar second sidewall portion 92 in which are formed a pair of apertures 62B, 64B which are adapted to lockingly engage assembly pins 62A, 64A, respectively, so as to securely mount chassis plate 90 upon chassis frame 42. Still referring to FIG. 1A, a raised land portion 94 of generally square periphery is seen to be formed on second sidewall portion 92 and projects laterally outwardly thereof. Land portion 94 has a bore 96 (FIG. 1) of circular cross section extending therethrough and through chassis plate 90. Spaced longitudinally apart on either side of land portion 94 are a pair of passage openings 98, 98' (FIG. 1) of generally rectangular cross section but having rounded or fillet corners. Passage openings 98, 98' are dimensioned and configured to receive therein for easy sliding passage therethrough shaft elements 16, 16'. Longitudinally spaced apart on opposite sides of openings 98, 98' are sprocket wheel opening 100 and idler bearing opening plate 102. Wheel opening 100 is circular in shape and is adapted to receive rotatably therein outer surface 72B of center cylindrical portion 72 of sprocket wheel 70. Similarly, idler bearing opening 102 is circular in shape and is adapted to rotatably receive therein outer surface 56B, the reduced diameter portion of idler wheel bearing 56. The cylindrical outer surface 56A of the large diameter portion of bearing 56 is adapted to receive idler wheel 66 rotatably thereon as indicated above.

Chassis plate 90 has a parting arm 104 (FIG. 1) formed at its end thereof which is adapted to be positioned adjacent to discharge end shoulder 54 of chassis frame 42. Parting arm 104, as best seen in FIG. 1A, is triangular in cross section and, when chassis plate 90 is mounted upon chassis frame 42, extends entirely across the gap provided between plate 90 and frame 42 as described more fully hereinbelow. Outside wall 106 of chassis 90 is disposed opposite to second sidewall portion 92.

Chassis plate 90 has a top surface 108 which has an initial horizontal segment 108A and rises in a slanted intermediate segment 108B to a higher elevation segment 108C which is contiguous with and at the same elevation as the top surface of parting arm 104.

Figure 2:
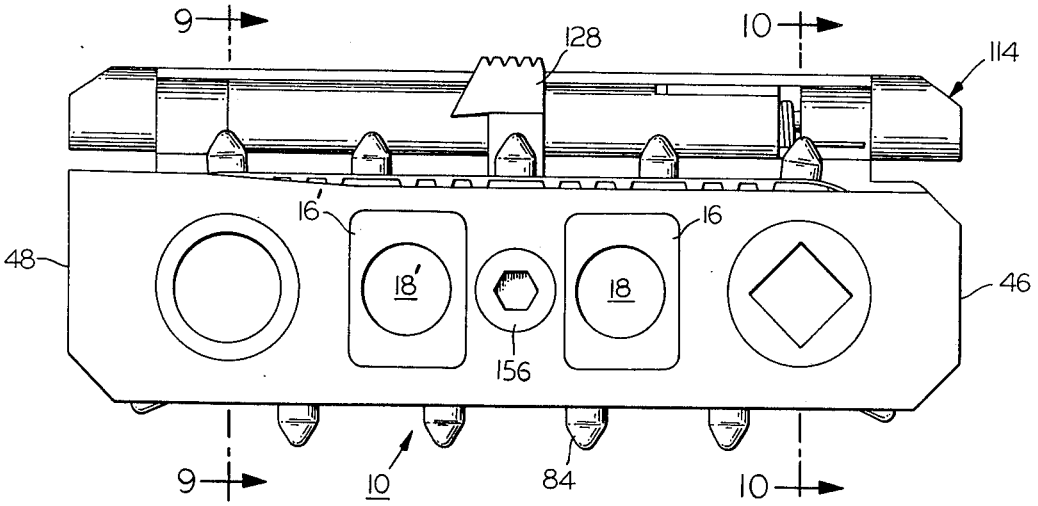
FIG. 2 is a side view in elevation of the assembled tractor of FIG. 1 with its cover in the open position.

Chassis frame 42 has a top surface 110 which has a horizontal segment 110A, an upwardly slanted segment 110B and a higher horizontal surface 110C which is at the same elevation as surface 108C. As described in more detail below, when chassis plate 90 is assembled to chassis frame 42, top surfaces 108 and 110 cooperate to define therebetween a pair of spaced apart top surfaces which cooperate to form a surface which rises from below driving surface 82 of belt 80 to a level above it in moving from feed end 46 to discharge end 48 of tractor 10 (FIG. 2).

Figure 5:
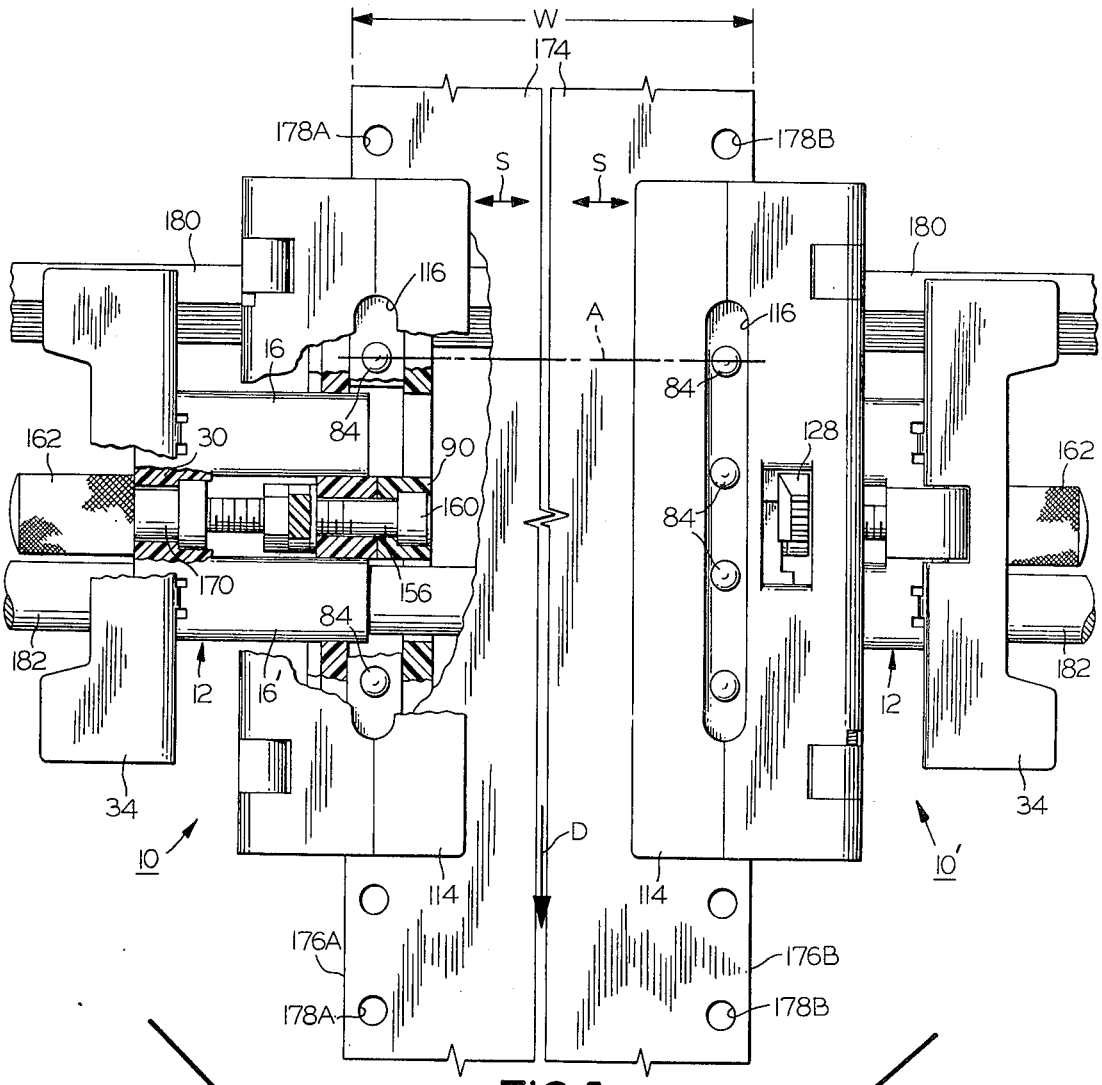
FIG. 5 is a top plan view of a pair of drive tractors engaging opposite edges of a web of paper, the drive tractor at the left-hand side of FIG. 5 being that of FIG. 1 and the drive tractor at the right-hand side of FIG. 5 being an otherwise identical tractor of opposite hand.

A pair of hinges 112, 112' are formed atop chassis frame 42, on respectively, the top surfaces of shoulders 52, 54. Hinges 112, 112' are longitudinally spaced apart along the longitudinal or first dimension of chassis frame 42. Hinges 112, 112' each contain a bore (unnumbered) passing therethrough parallel to the longitudinal axis of chassis frame 42. A cover plate 114 is generally rectangular in shape and has a central, longitudinal slot 116 formed therein as best seen in FIGS. 1 and 5. FIG. 5, as previously indicated, shows a pair of drive tractors 10 and 10'. Drive tractor 10' is identical to drive tractor 10 except that it is of the opposite hand. Accordingly, corresponding parts of the two drive tractors are identically numbered.

Cover plate 114 has formed on the underside thereof longitudinally extending bearing surfaces 118, 118' extending along opposite edges of slot 116. A longitudinally extending bore 120 extends through cover plate 114 parallel to and adjacent hinge edge 114A and is aligned with the bores formed in hinges 112, 112' so that cover plate pins 122, 122' may be inserted therein to mount cover plate 114 for hinged rotation about chassis frame 42. A torsion spring 124 encircles cover plate hinge pin 122 and is received within a torsion spring retaining compartment 126 formed in cover plate 114 to spring bias cover plate 114 towards its open position illustrated in FIG. 7A.

Figure 6A:
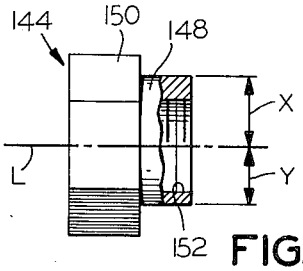
FIG. 6A is an enlaged view of the bearing nut component of the assembly shown in FIG. 6.
Figure 6:
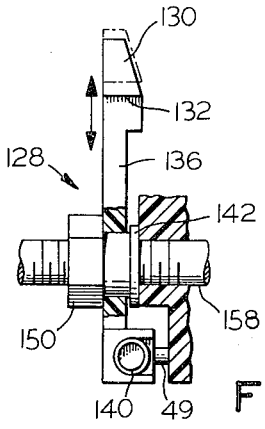
FIG. 6 is a partial view in elevation of the cover latch of the drive tractor of FIG. 1.

A cover latch 128, as shown in FIGS. 1 and 6, has a catch portion 130 having a lip 132 formed at the lower portion thereof. A central bearing retainer socket 134 of circular cross section is formed in body portion 136. At the lower end of cover latch 128 a compression spring retaining compartment 138 is formed to receive therein one end of a compression spring 140. A washer 142 and a bearing nut 144 are employed to mount cover latch 128 on chassis frame 42. For the purpose, chassis frame 42 has a latch mounting pier 146 formed therein between passage openings 98 and 98'. Bearing nut 144 is shown in enlarged view with parts broken away in FIG. 6A and is seen to comprise a cylindrical bearing portion 148 affixed to a conventional hexagonal nut 150. A central internally threaded bore 152 extends longitudinally through bearing nut 144 from one end thereof to the other. The bearing portion 148 is eccentrically mounted relative to nut 150 so that the distance X(FIG. 6A) between longitudinal center line axis L of nut 150 and one portion of cylindrical bearing portion 148 is greater than the distance Y from longitudinal axis L to a diametrically opposite portion of the outer surface of cylindrical bearing 148. This arrangement permits adjusting the height of lip 132 of cover latch 128 by rotating bearing nut 144 as will be described hereinbelow in greater detail. Latch mounting pier 146 has a central circular cross section bore 154 formed therein and extending therethrough.

Positioning means are provided by the combination of a threaded shaft 156 and turnbuckle nut 162. Shaft 156 has a threaded shank 158 and an enlarged head 160 which is adapted to be seated within counterbored passage opening 98.

Turnbuckle nut 162 has a knurled barrel portion 164 separated from a disc shaped face portion 168 by a longitudinally extending cylindrical neck portion 170. Both barrel portion 164 and face portion 168 have substantially cylindrical outer surfaces and are of equal cylindrical diameter. Neck portion 170 also has a cylindrical shaped outer surface area but one of lesser cylindrical diameter than that of portions 164, 168. The shoulder portions separating barrel portion 164 and face portion 168, respectively, from narrowed neck portion 170 are disposed perpendicularly to the longitudinal central axis of turnbuckle 164. An interiorly threaded turnbuckle bore 172 extends longitudinally through turnbuckle nut 162 for almost the entire length thereof, commencing at face portion 168 and stopping short of the opposite end of turnbuckle 162. Turnbuckle bore 172 is threaded to threadably rotatably engage threaded shank 158 of threaded shaft 156.

As shown in FIG. 5 with reference to drive tractor 10, narrowed neck portion 170 is adapted to be rotatably seated within U-shaped lip 30 of connecting web portion 24. To assemble a drive tractor from its component parts it is necessary only to slip idler wheel 66 and drive sprocket wheel 70 over their respective bearings 56, 58 and train belt 80 over wheels 66 and 70 with belt teeth 88 meshed with the teeth on wheels 66 and 70. Chassis plate 90 is then mounted upon chassis frame 42 by engagement of assembly pins 62A, 64A with respective apertures 62B, 64B. Cover plate 114 mounted to chassis frame 42 by means of cover plate hinge pins 122, 122' which are passed, respectively, through bore 120 and the bores (unnumbered) in hinges 112, 112'. Torsion spring 124 is emplaced and the opposite legs thereof seat, respectively, against cover plate 114 and hinge 112. Cover latch 128 is mounted on chassis frame 42 with compression spring 140 having one end received within its retaining compartment 138 and its opposite end abutted against a vertically extending flange 51 projecting outwardly of web portion 50, as best seen in FIG. 3. A retaining pin 49 projects outwardly of web portion 50 adjacent the lower end of cover latch 128. Compression spring 140 is thus compressed between hinge 51 and retaining compartment 138. Retaining pin 49 serves to provide a stop for pivoting movement of latch 128 about its cylindrical bearing portion 148.

As shown in FIG. 3, chassis frame 42 is provided with frame passage openings 99, 99' which are of substantially identical configuration as passage openings 98, 98' of chassis plate 90. With chassis plate 90 mounted to chassis frame 42 passages 98, 99 and 98', 99' are in axial alignment and together cooperate to provide tracking means comprising a pair of passages 101, 101' (FIG. 3). Shaft 156 is threaded through chassis frame 42 and plate 90.

Body portion 12 is mounted upon chassis 14 by passing shaft elements 16, 16', respectively, into passages 101, 101' for sliding movement therein. The outer surfaces of shaft elements 16, 16' are configured to closely but slideably pass within passages 101 and 101' and to be constrained for linear sliding movement therein.

Threaded shaft 156 is then passed through bore 96, bore 154 and extends between shaft elements 16 and 16', as may best be seen in FIG. 5 with respect to tractor 10 thereof. Turnbuckle nut 162 is seated upon lip 30 and the end of threaded shaft 156 opposite its head 160 is threadably engaged with turnbuckle bore 172.

Assembled tractor 10 is now ready for placement upon a support means. Referring again to FIG. 5, there is shown an assembly for driving web material, including a pair of drive tractors 10, 10'. Tractor 10 is shown in plan view with parts broken away for ease of illustration. A paper web 174 has its central portion omitted. It will be appreciated by those skilled in the art that paper web 174 may be any web material but is normally a printing paper, such as computer printout paper, having opposite edge portions 176A, 176B. A series of perforations 178A, 178B are provided in a single longitudinally extending line adjacent, respectively, opposite edge portions 176A, 176B. For computer printout paper, typically, the edge to edge width (W in FIG. 5) is 38 centimeters (14 $\frac{3}{4}$ inches), the center line of the perforations are 0.635 cm ($\frac{1}{4}$ inch) in from the respective edges of the paper and the perforations are spaced apart in the line of perforations 1.270 cm ($\frac{1}{2}$ inch) center to center. The diameter of the perforation is 0.404 cm (0.159 inch). Opposite edges of paper web 174 are gripped by tractors 10, 10' for driving of web 174 in the direction indicated by the arrow D in FIG. 5.

Figure 5A:
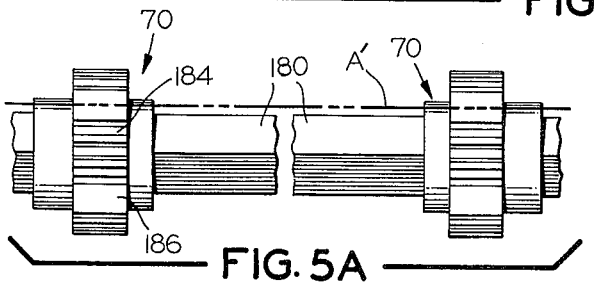
FIG. 5A is a top plan view with parts broken away of the respective drive sprockets of the two drive tractors shown in FIG. 5.

As hereinabove indicated, drive tractor 10' is identical to drive tractor 10 described above, except that it is of the opposite hand with respect, for example, to the configuration of top surfaces 108, 110 so that the two drive tractors may drive from opposite edges of web 174. Referring to FIGS. 5 and 5A, a drive shaft 180 has a square cross section and is suitably journaled at its opposite ends (not shown) and connected to be rotated by a suitable electric motor or the like to provide power to drive tractors 10 and 10' as is well known in the art. As is also well known in the art, a support rod 182 of circular cross section extends parallel to and substantially coextensively with drive shaft 180. Support rod 182 is associated with the printing or other equipment of which drive shaft 180 is a part. The provision of such support rods 182 is a common expedient to provide support for drive tractors 10, 10' in proximity to drive shaft 180. Tractors 10, 10' are mounted on support rod 182 by seating one of central bores 18, 18' onto support rod 182 for sliding movement thereover.

Figure 8:
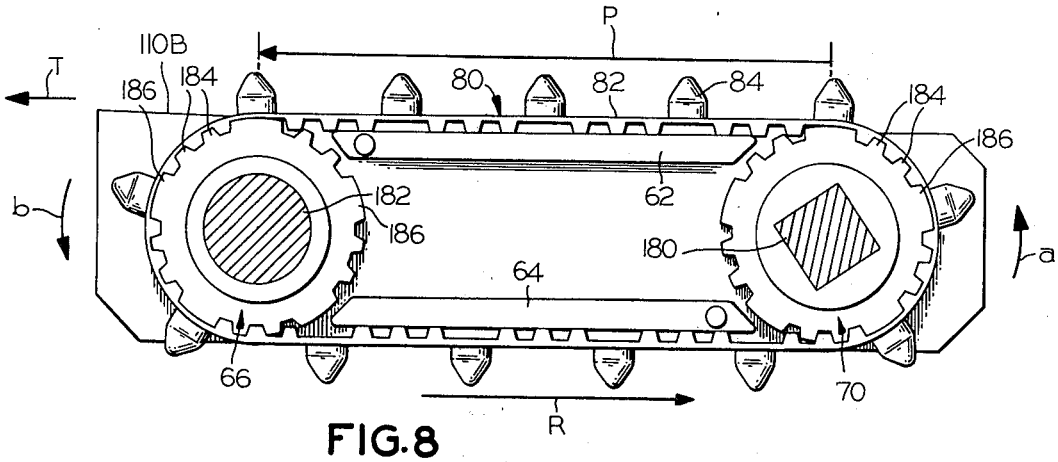
FIG. 8 is a view corresponding to that of FIG. 2 but with parts omitted for clarity of illustration and showing the device mounted on a support rod and engaged with a drive shaft as shown in FIG. 5.
Figure 11:
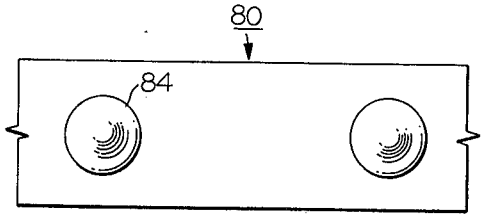
FIG. 11 is a partial plan view on an enlarged scale of a segment of the drive belt of the tractor of FIG. 1.

As best seen in FIG. 8, the outer surface of support rod 182 is sized and configured to receive the inner surface of, in the case of tractor 10, bore 18' thereover in closely fitting but slideable engagement therewith. The two tractors are positioned apart the required distance to align, in the direction D of belt and web material travel, perforations 178A with pins 84 of tractor 10 and perforations 178B with pins 84 of tractor 10'. Locking tab 34 is then flipped downwardly into its horizontal position which causes bosses 40 to deflect projecting tabs 38, 38' downwardly as shown in FIG. 4A. This securely locks base members 12 in spaced apart relationship to a common supporting rod 182.

Obviously, depending on the configuration of the particular type machine employed, support rod 182 may comprise two separate stub rods. However, normally, a single elongated support rod is provided so that the paired tractors may be slid therealong to the desired distance apart from each other. This arrangement, which is well known and understood to those skilled in the art, is illustrated in FIG. 5A in which the respective sprocket wheels are drivingly engaged by a common drive shaft 180. By virtue of the square cross section of drive shaft 180 and the complementary square cross section of shaftway 78 of drive sprocket wheel 70, rotation of drive shaft 180 by a suitable motor or other means (not shown) likewise rotates each of sprocket wheels 70.

Figure 7:
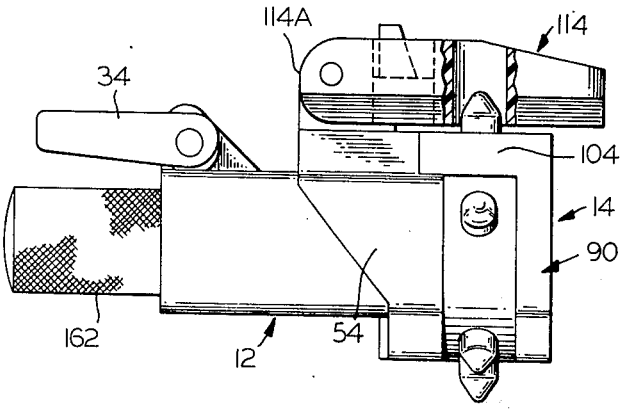
FIG. 7 is an end view in elevation of the tractor of FIG. 1 showing its cover in the closed position.
Figure 7A:
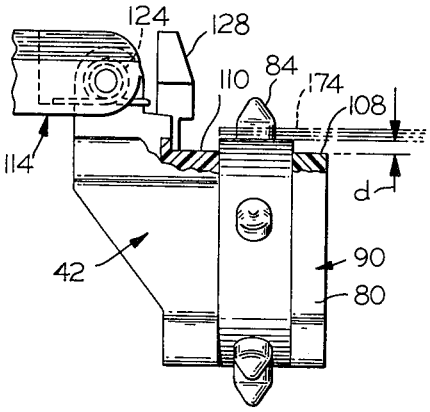
FIG. 7A is a view corresponding to FIG. 7 but with parts broken away and showing the cover in its open position with a plurality of webs of paper material indicated in dot-dash line.

Referring jointly to FIGS. 1, 5A and 8, sprocket teeth 184, 186 are spaced apart along the periphery of ring 74 of wheel 70. Sprocket teeth 184 are of relatively narrow radial width as compared to sprocket teeth 186 which are configured differently in that they are radially wider. Sprocket teeth 186, in fact, may be considered to be an untoothed portion of the periphery of wheel 70 in the embodiment illustrated. The smaller, i.e., radially narrower, sprocket teeth 184 are each the same size and equally spaced apart from their adjacent sprocket tooth 184 and disposed between sprocket teeth 186. Idler wheel 66 also has a circular peripheral rim which has identical toothing provided by teeth 184 and differently configured teeth 186. The engagement of belt 80 with wheels 66 and 70 is clearly shown, as is the driving engagement of drive shaft 180 with wheel 70. Belt 80 is supported and guided by elements 62 and 64. Rotation of drive shaft 180 rotates sprocket wheel 70 and drives belt 80 along the drive path indicated by the arrow P in which pins 84 of belt 80 are fully engaged with perforations 178A, 178B to drive paper web 174. Paper web 174 is supported on driving surface 82 of belt 80. As belt 80 begins to drive downwardly around idler wheel 66 as indicated by the arrow b, belt 80 separates from paper web 174 which continues, at least momentarily, in the direction of arrow T to be received by another piece of equipment or a storage tray or the like. Belt 80 continues along its return path indicated by the arrow R and curves upwardly about sprocket wheel 70 as indicated by the arrow a. As belt 80 curves upwardly about sprocket wheel 70, pins 84 engage incoming perforations of paper web 174. Generally, full engagement of pins 84 with paper web 174 takes plce in the drive path which may be considered to be that portion of belt 80 disposed between vertical (as viewed in FIG. 8) center lines passing through the axes of rotation of wheels 66 and 70. Wheels 66, 70 and support element 62 and guide element 64 cooperate to train belt 80 in the form of a loop. As best seen in FIG. 7A, side edges of belt 80 are held against shifting by first and second sidewall portions 44, 92.

Figure 12:
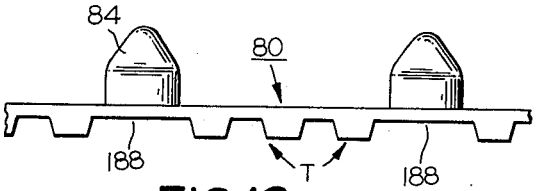
FIG. 12 is a side view in elevation of a segment of the belt of FIG. 11.

Referring to FIG. 12, belt 80 is seen to be provided on its inner driven surface 86 with a plurality of belt teeth 88. The belt teeth are configured to drivingly mesh with the sprocket and idler wheel teeth 184, 186 and to this end the drive formation or tread (generally indicated by T in FIG. 12) provides locating segments 188 thereof which are, in the embodiment illustrated, untoothed segments of belt 80. Locating segments 188 are sized and configured to mesh with differently configured sprocket and idler wheel teeth 186 as best seen in FIG. 8. It should be noted that the spacing of locating segments 188 is repeated at regular intervals corresponding to the spacing between adjacent teeth 84. Locating segments 188 are therefore formed at selected positions along the length of belt 80 relative to the position therealong of pins 84. In other words, the relative location along the longitudinal center line of belt 80 of any pin 84 to a corresponding locating segment 188 is constant. In the illustrated embodiment, each pin 84 is centered with respect to the longitudinal extent of its corresponding locating segment 188. Thereby, by training belt 80 over sprocket wheel 70 (and idler wheel 66) each pin 84 is placed at a selected location along its path of travel relative to the rotational position of sprocket wheel 70.

As shown in FIGS. 5 and 5A, shaftway 78 is of polygonal (square in the illustrated embodiment) cross section and this provides wheel 70 with orientation relative to the associated drive member (drive shaft 180). Since both tractors 10 and 10' are operatively connected to a common drive shaft 180 and their respective drive or sprocket wheels 70 are identically configured, the respective drive wheels 70 are necessarily positioned in the identical rotational orientation. FIG. 5A illustrates the alignment of the respective sprocket wheels 70 of tractors 10 and 10' and shows that the respective sprocket teeth are, necessarily, similarly transversely aligned as indicated by dot-dash line A'. Thus, when sprocket wheel 70 of tractor 10 is in the position illustrated in FIG. 8, with one of the differently configured teeth 186 centered at the top of the wheel along the vertical center line thereof, the sprocket wheel 70 of its paired drive tractor 10' is necessarily identically positioned because both sprocket wheels 70 are identically configured and dimensioned. The result is that the pins 84 of the respective belts 80 of drive tractors 10 and 10' are aligned transversely of the drive path of the belts 80. This is indicated by the dot-dash line A in FIG. 5, showing transverse alignment of paired pins 84. Thus, the act of connecting tractors 10, 10' to drive shaft 180 automatically transversely aligns pins 80 of the two tractors with each other and the possibility of operator error, and the trouble of taking steps to provide the alignment while connecting the tractors is precluded.

With cover plates 114 in the open position, a web of material such as computer printout paper having edge perforations thereon is placed between the tractors 10 and 10' and the perforations thereof seated upon the pins 84 positioned in the drive path. Cover plates 114 are then closed, latch 128 locking them in place and longitudinally extending bearing surfaces 118 of cover plates 114 maintaining the opposite edge portions of the paper web 174 in place. Rotation of drive shaft 180 now drives both drive or sprocket wheels 70, which drives both belts 80 to drive paper web 174 in the direction of arrow D in FIG. 5. To adjust transverse tension in the belt, turnbuckles 162 may be rotated selectively in either direction to laterally "fine-tune" shift respective ones of chassis 14 relative to its associated base member 12 as indicated by the arrows S in FIG. 5. Obviously, tractors 10, 10' may also have conventional mounting means instead of the shiftable chassis construction illustrated.

While drive tractors in accordance with the invention may, of course, be made of any suitable material, including metal, e.g., aluminum, it is preferred that the drive tractor be made from a plastic, i.e., synthetic organic polymeric material. In a preferred embodiment, the drive tractor is molded from a polycarbonate material, preferably one admixed with a fluorocarbon material such as that sold under the trademark TEFLON by E. I. DuPont deNemours and Company. The drive belt is preferably made of a glass-filled polyester material.

Figure 9:
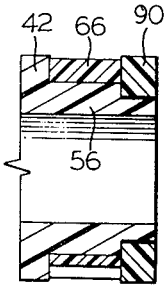
FIG. 9 is a partial section view taken along line 9—9 of FIG. 2.
Figure 10:
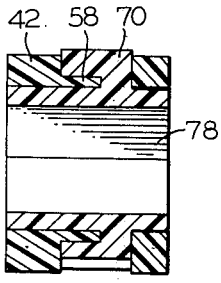
FIG. 10 is a partial section view taken along line 10—10 of FIG. 2.

Modern plastic molding techniques are more than adequate, particularly when utilizing a polycarbonate material, to provide molded parts of sufficiently close tolerance to insure good fit and smooth operation of the drive tractors. In this regard, FIGS. 9 and 10 show in cross sectional view the mounting of, respectively, idler wheel 66 and sprocket wheel 70 to their respective associated bearings. While the bearings and wheels must be made to close tolerances to insure smooth rotation and reduce friction, the design of the preferred embodiment provides that openings 100 and 102 may be made slightly oversized so that the size of these openings need not be held to close tolerances. This reduces the general overall molding cost.

As illustrated in FIG. 7A, top surfaces 108, 110 are, for the major portion of travel of the belt along its limited drive path, recessed below paper webs 174 by the distance d indicated by the dimension arrows in FIG. 7A. This permits paper webs 174, which may be driven in multiple layers as indicated in the dot-dash lines in FIG. 7A, to be firmly seated at the base of pins 84 without interference from the top surfaces. Adjacent the discharge end of the tractors, top surfaces rise to the level, at least, of driving surface 82 of belts 80 and cooperate with parting arm 104 to insure clean disengagement of paper web 174 with pins 84 of belt 80.

The tractors are provided with double sets of openings therein to receive a support rod and a drive shaft. Normally, one support rod and one drive shaft is engaged with each tractor. Obviously, the tractors may be mounted on double spaced apart support rods. The provision of double passages permits flexibility in positioning the tractors on various pieces of equipment.

While the invention has been described in detail with respect to a specific illustrated preferred embodiment thereof, it will be apparent to those skilled in the art that, upon a reading and understanding of the foregoing, numerous alterations and modifications will be made to the specifically disclosed structure which are nontheless within the spirit of the invention and it is intended to include such alterations and modifications within the scope of the amended claims.

What is claimed is:

1. A drive tractor for driving web material comprising:

(a) a chassis having means thereon for mounting said chassis in proximity to a drive member;

(b) belt driving means mounted on said chassis and including a drive wheel mounted for rotation on said chassis and adapted to be operatively connected to the associated drive member to be rotated thereby, said drive wheel having a locating element on the periphery thereof;

(c) a flexible endless belt having an outer driving surface and an inner driven surface, said belt driven surface engaging said drive wheel for driving of said belt in a path of travel and including a locating formation thereon dimensioned and configured to mesh with said wheel locating element but not with other segments of said drive wheel periphery, said belt outer surface having a plurality of spaced apart pin members disposed along the length thereof and projecting outwardly therefrom, said pin members being adapted to engage a web material for driving thereof along a portion of said path of travel; said belt locating formation having a predetermined spatial relationship relative to said belt pin members whereby engagement of said belt locating formation with said wheel locating element places said pin members at respective predetermined locations along said path of travel relative to the rotational position of said drive wheel.

2. The drive tractor of claim 1 wherein said drive wheel includes orientation means thereon configured to fix said drive wheel in a given rotational orientation relative to the associated drive member.

3. The drive tractor of claim 1 wherein said drive wheel has a plurality of sprocket teeth formed along its periphery and including at least one sprocket tooth differently configured from others of said sprocket teeth, and said locating element comprises said differently configured sprocket tooth.

4. The drive tractor of claim 3 wherein said belt inner surface has a drive formation formed thereon comprising a plurality of belt teeth dimensioned and configured to drivingly mesh with said sprocket teeth and said drive formation includes at least one locating segment thereof dimensioned and configured to mesh with said differently configured sprocket tooth but not with said others of said sprocket teeth.

5. The drive tractor of claim 4 wherein said drive wheel has a plurality of first sprocket teeth comprising said differently configured sprocket teeth and a plurality of second sprocket teeth of different radial width than said first plurality of sprocket teeth and located between said first sprocket teeth, and said drive formation has a plurality of spaced apart locating segments, each dimensioned and configured to snugly mesh with respective ones of said first sprocket teeth but not with ones of said second sprocket teeth.

6. The drive tractor of claim 4 further including an idler wheel mounted for rotation on said chassis, said idler wheel having a plurality of sprocket teeth formed along its periphery, said idler wheel sprocket teeth being configured similarly to said drive wheel sprocket teeth and adapted to be drivingly meshed with said belt formation in the like manner as said drive wheel sprocket teeth.

7. The drive tractor of claim 5 wherein said first sprocket teeth are radially wider than said second sprocket teeth and said locating segments comprise untoothed portions of said belt drive formation, each of said untoothed portions being dimensioned and configured to snugly receive therein a first sprocket tooth.

8. The drive tractor of claim 2 wherein said orientation means comprises a mounting shaftway formed in said drive wheel and having a polygonal cross section.

9. An assembly for driving web material, including a pair of drive tractors, each drive tractor comprising:

(a) a chassis having means thereon for mounting said chassis in proximity to a drive member;

(b) belt driving means mounted on said chassis and including a drive wheel mounted for rotation on said chassis and adapted to be operatively connected to the associated drive member to be rotated thereby, said drive wheel having a locating element on the periphery thereof;

(c) a flexible endless belt having an outer driving surface and an inner driven surface, said belt driven surface engaging said drive wheel for driving of said belt in a path of travel and including a locating formation thereon dimensioned and configured to mesh with said wheel locating element but not with other segments of said drive wheel periphery, said belt outer surface having a plurality of spaced apart pin members disposed along the length thereof and projecting outwardly therefrom, said pin members being adapted to engage a web material for driving thereof along a portion of said path of travel; said belt locating formation having a predetermined spatial relationship relative to said belt pin members whereby engagement of said belt locating formation with said wheel locating element places said pin members at respective predetermined locations along said path of travel relative to the rotational position of said drive wheel.

10. The assembly of claim 9 wherein said drive member is an elongated drive shaft and said tractors are spaced apart along said drive shaft and have their respective drive wheels engaged therewith and disposed in the identical rotational orientation relative to said drive shaft whereby the respective pin members of said belts are transversely aligned relative to the direction of belt travel.

11. The assembly of claim 9 wherein said drive wheels each includes orientation means thereon configured to fix said drive wheels in the identical rotational orientation relative to said drive shaft.

12. The assembly of claim 11 wherein said orientation means comprises a mounting shaftway formed in each of said drive wheels and having a polygonal cross section, and wherein said drive shaft has a congruently configured polygonal cross section sized to be snugly slidably received within said shaftway.

13. The assembly of claim 10 wherein each of said drive wheels has a plurality of sprocket teeth formed along its periphery and including at least one sprocket tooth differently configured from others of said sprocket teeth, and said locating element comprises said differently configured sprocket tooth.

14. The assembly of claim 13 wherein each of said belt inner surfaces has a drive formation formed thereon comprising a plurality of belt teeth dimensioned and configured to drivingly mesh with said sprocket teeth of its respective drive wheel and said drive formations each includes at least one locating segment thereof dimensioned and configured to mesh with said differently configured sprocket tooth but not with said others of said sprocket teeth of its respective drive wheel.

15. The assembly of claim 14 wherein each of said drive wheels has a plurality of first sprocket teeth comprising said differently configured sprocket teeth and a plurality of second sprocket teeth of different radial width than said first plurality of sprocket teeth and located between said first sprocket teeth, and wherein each of said drive formations has a plurality of spaced apart locating segments, each dimensioned and configured to snugly mesh with respective ones of said first sprocket teeth but not with ones of said second sprocket teeth of its respective drive wheel.

16. The assembly of claim 14 wherein each of said tractors further includes an idler wheel mounted for rotation on its respective chassis, said idler wheels each having a plurality of sprocket teeth formed along its periphery, said idler wheel sprocket teeth being configured similarly to said drive wheel sprocket teeth and adapted to be drivingly meshed with said belt formation of its associated belt in the like manner as said drive wheel sprocket teeth.

17. The assembly of claim 9 further including a support comprising an elongated support bar disposed in proximity to said drive member and adapted to have said tractors mounted thereon spaced apart from each other.

* * * * *